US007472902B2

(12) United States Patent
Moore et al.

(10) Patent No.: US 7,472,902 B2
(45) Date of Patent: Jan. 6, 2009

(54) SYSTEM AND METHOD FOR IMPROVING TOP SHEET ACQUISITION IN A PRINTING MACHINE

(75) Inventors: Kenneth Paul Moore, Rochester, NY (US); Brian Roy Ford, Walworth, NY (US); Timothy Gordon Shelhart, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 472 days.

(21) Appl. No.: 11/284,039

(22) Filed: Nov. 21, 2005

(65) Prior Publication Data

US 2007/0063419 A1 Mar. 22, 2007

(51) Int. Cl.
*B65H 3/14* (2006.01)
*B65H 3/08* (2006.01)
*B65H 5/08* (2006.01)

(52) U.S. Cl. ..... 271/98; 271/11; 271/91; 271/107

(58) Field of Classification Search ..... 271/98, 271/107, 14, 11, 90, 93, 94
See application file for complete search history.

(56) References Cited

U.S. PATENT DOCUMENTS 4,627,606 A 12/1986 Moore
6,450,493 B1 9/2002 Milillo et al.

*Primary Examiner*—Patrick H Mackey
*Assistant Examiner*—Luis Gonzalez
(74) *Attorney, Agent, or Firm*—Maginot, Moore & Beck

(57) ABSTRACT

An apparatus that is useful for acquiring and conveying a sheet includes a plenum having an opening for coupling a vacuum source to the plenum, a slide plate having a stop member positioned proximate a drop box opening in the slide plate, and a drop box adapted to slide within the drop box opening until a portion of the drop box engages the stop member so that the drop box is slidably installed in the slide plate. The apparatus may be used in an electrostatographic printing machine to improve top sheet acquisition.

17 Claims, 15 Drawing Sheets

FIG. 15
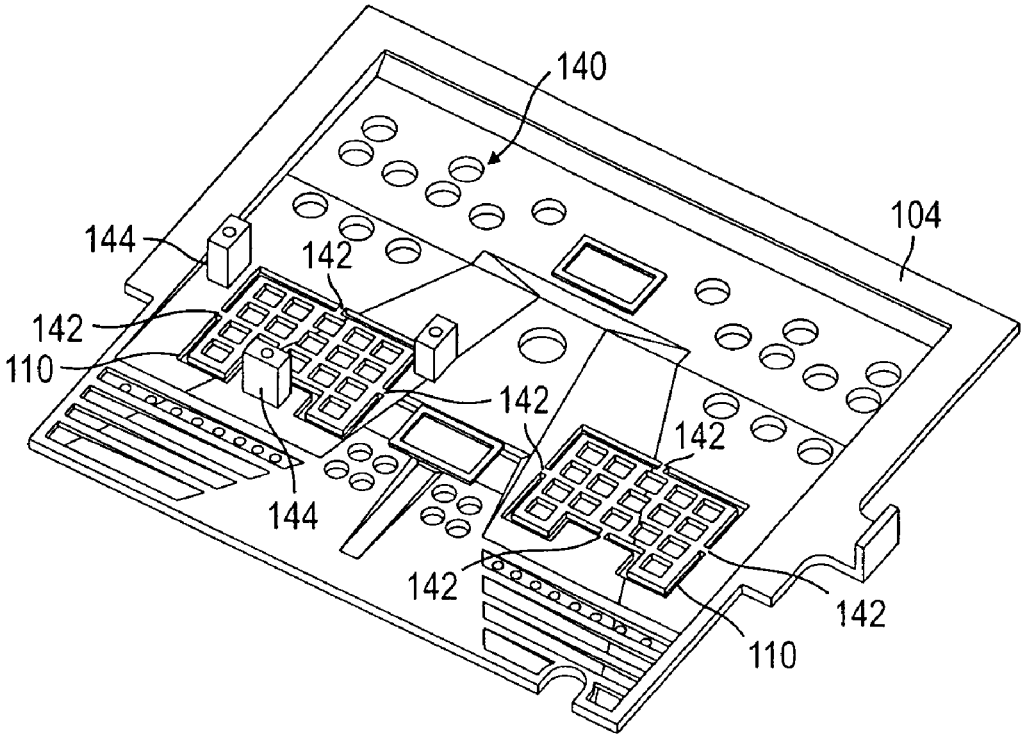
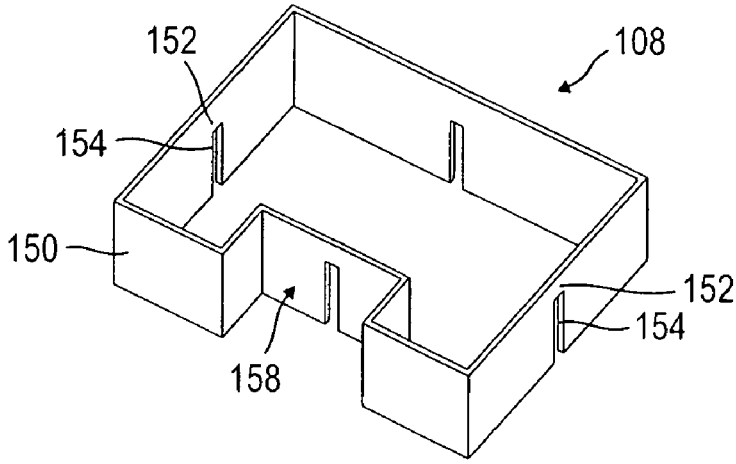
FIG. 16

SYSTEM AND METHOD FOR IMPROVING TOP SHEET ACQUISITION IN A PRINTING MACHINE

PRIORITY

This application claims benefit of U.S. patent application entitled "Integrated Vacuum Slide Feeder" that was filed on Sep. 20, 2005 and assigned Ser. No. 11/230,961, the disclosure of which is incorporated in its entirety herein.

BACKGROUND

This disclosure relates generally to a sheet feeder for use in a printing machine, such as an electrophotographic reproduction machine. More particularly the disclosure concerns use of a vacuum to remove sheets from a stack and transfer the sheets to the imaging portion of the electrophotographic reproduction machine.

In one type of electrophotographic printing or reproduction machine, such as the machine M shown in FIG. 1, a photoconductive member or belt 10 is charged by a corona generating device 12 at a station A to a substantially uniform potential so as to sensitize the surface thereof. At a station B, the charged portion of the photoconductive member 10 is exposed to a light image of an original document being reproduced obtained from a scanning device, such as a raster output scanner 14. Exposure of the charged photoconductive member selectively dissipates the charges thereon in the irradiated areas which records an electrostatic latent image on the photoconductive member corresponding to the informational areas contained within the original document.

After the electrostatic latent image is recorded on the photoconductive member, the latent image is developed by bringing a developer material into contact therewith at a series of developer stations C and D. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. For a typical black and white electro-photographic printing machine, a single development station C may be provided. On the other hand, with the advent of multicolor electrophotography, multiple additional development stations D may be provided that fix color toner to the photoconductive member 10.

Subsequent to image development, a sheet S of support material is moved into contact with the toner images at a transfer station G. At this station, a transfer dicorotron 16 sprays positive ions onto the backside of the sheet S which attracts the negatively charged toner particle images from the photoreceptor 10 to the sheet S. A detack corotron 18 is provided for facilitating stripping of the sheet S from the surface of the photoreceptor. After transfer, the sheet S travels to a fusing station H where a heated fuser roller assembly 20 permanently affixes the toner powder to the sheet S.

Many high speed color printers, such as those described above, are designed to feed a wide variety of sheet types for various printing jobs. Customers demand that such a machine be able to image on stock having different dimensions, a wide range of paper weights, and appearance characteristics that vary from rough flat appearing sheets to very high gloss coated paper stock. Each of these sheet types and size has its own unique characteristics and in many instances present very different problems associated the high speed feeding of the sheet types to the imaging section of the machine.

There is shown in FIG. 2, a side elevational schematic view of a high speed sheet feeder, generally indicated by reference numeral 200. The basic components of the feeder 200 include a sheet support tray 210, which may be tiltable and self adjusting to accommodate various sheet types and characteristics; multiple tray elevator mechanisms 220, 230; a vacuum shuttle feedhead 300; a lead edge multiple range sheet height sensor 340; a multiple position stack height sensor 350; a variable acceleration take a way roll (TAR) 400; inboard and outboard sheet fluffers 360, and trail edge fluffer 362.

The feedhead is a top vacuum corrugation feeder (VCF), so distance control of the top sheets in the stack T from the acquisition surface 302 and the fluffer jets 360 and 362 are very important. The acquisition surface 302 is the functional surface on the feed head 300 or vacuum plenum. The two sensors 340, 350 together enable the paper supply to position the stack T. The multi-position stack height sensor 350 contacts the sheet stack T to detect two or more specific stack heights. This sensor 350 works in conjunction with the second sensor 340 near the stack lead edge which also senses the distance to the top sheet, but without sheet contact. The two sensors together enable the paper supply to position the stack T with respect to an acquisition surface 302 of the feedhead 300, both vertically and angularly in the process direction. This height and attitude control greatly improves the capability of the feeder to cope with a wide range of paper basis weight, type, and curl.

The paper feeder 300 acquires individual sheets S of paper (using air pressure) from the top of a stack T and transports them forward to the TAR 400. Among the independent variables in the paper feeder design are three sets of air pressures, including air knife pressure and fluffer pressures that supply air for sheet separation and vacuum pressure that causes sheets to be acquired by the shuttle feed head assembly. Each set of pressures is supplied from one combination blower or may be supplied by an independent blower. As fluffer pressure increases the sheets on the top of the stack become more separated with the top most sheets being lifted closer to the vacuum feed head. As the fluffing pressure gets higher, the risk of more than one sheet being moved into the take-away nip as the feed head moves also increases, (a.k.a. multifeed). As the fluffing pressure gets lower, the risk of the top sheet not getting close enough to the feed head (and thus not becoming acquired by the vacuum present on the bottom of the feed head) increases. This failure results in no sheet being fed when the feed head moves forward, (a.k.a., misfeed or late acquisition). The optimum amounts of fluffer and vacuum feed-head pressures are a function of the size and weight of the sheets (larger, heavier sheets requiring more fluffing and vacuum and visa-versa for smaller, lighter sheets).

During each sheet feed, when the trailing edge of the sheet passes the stack height arm 352 (FIG. 3), the arm compresses the stack T, the stack height sensors 340, 350 measure the position of the solid stack, and the stack height arm 352 is raised again after about 25 ms. The timing of the movement of the arm is controlled by a cam 348 that is driven by a stepper motor 310. Once the trailing edge of the sheet S passes the position of the lead edge sensor 340, the position of the leading edge of the fluffed stack T is measured. The values of these measurements are then compared to the desired states for the paper being fed and the tray is adjusted accordingly. The fluffer jets 360, 362 remain activated during these steps.

The feed head 300 is a top vacuum corrugation feeder which incorporates an injection molded plenum/feed head 301 with a sheet acquisition and corrugation surface 302, as shown in FIGS. 2 and 3. The feed head 300 is optimally supported at each corner by a ball bearing or other low friction roller/track assembly 304. In a typical installation, the feed head 300 is driven forward twenty mm and returned twenty mm to its home position by a continuous rotation and direction twin slider-crank drive 346 mounted on the double shaft stepper motor 310. This feed head travel includes five mm of over-travel to account for paper loading tolerance and misregistration. This drive results in a linear sheet speed of about 420 mm/s as the sheet is handed off to the take away roll 400 (TAR). The TAR 400 may also be stepper driven to accelerate the sheet S up to transport speed. The feed head 300 supports each sheet fully as it is carried to the TAR 400. This approach avoids a "pushing on rope" syndrome that plagued earlier systems.

Thus, the prior sheet feed apparatus 300 includes a vacuum source, the vacuum source being selectively actuatable to acquire and release a top sheet from a stack; a feed head that is attached to the vacuum source to acquire the top sheet of the stack; and a unidirectional drive mechanism that is driven in a single direction to cause the feed head to reciprocate from a first position to a second position. Additionally, the sheet feed apparatus can include a stack height sensor actuator coupled to the unidirectional drive mechanism and a stack height sensor attached to the stack height sensor actuator so that the stack height sensor contacts and disengages the sheet stack at a preselected time coordinated with the reciprocating motion of the feedhead. Moreover, the stack height sensor actuator may comprise a cam member that is attached to the unidirectional drive mechanism and rotating therewith; a biasing member; a cam follower that is attached to the biasing member and biased into contact with said cam and attached to said stack height sensor to control the movement of said stack height sensor. Furthermore, the sheet feed apparatus may include a unidirectional drive mechanism which comprises a stepper motor operating in a unidirectional rotational mode.

In these prior feeder mechanisms, the entire sheet feed apparatus 300 is propelled by the motor 310. Thus, the motor must be powerful enough to accurately and precisely move the apparatus 10 in order to transport a single sheet to the TAR 400. Such a motor is relatively expensive, generates a fair amount of heat and requires a relatively significant amount of energy to operate. Moreover, driving the entire sheet feeder mechanism imposes a limit on feed speed arising from the inertia of the mechanism 300, and increases the risk of skewing the acquisition surface 302 and, ultimately, the sheet S as it is received by the TAR. These limitations of previously known sheet feeders are addressed by the integrated slide feeder set forth in co-pending U.S. patent application entitled "Integrated Vacuum Slide Feeder" that was filed on Sep. 20, 2005 and assigned Ser. No. 11/230,961.

In some previously known sheet feeders, the sheet feed apparatus includes a vacuum box that includes vertically displaceable skirts. The vertically displaceable skirts move downwardly under the force of gravity to lie proximate the top sheet of the stack. The interior of the vacuum box formed by the skirts is in fluid communication with a vacuum source to generate a negative pressure within the interior of the box. This negative pressure helps attract the top sheet towards the lower edge of the box. The stiffness of the paper moves the skirts vertically upwardly as the paper moves in response to the negative pressure inside the vacuum box. To facilitate the separation of the lower sheets from the top sheet, an air knife stream may be directed at the lead edge of the sheets being held above the stack by the negative pressure. Corrugation molded into the acquisition surface of the vacuum plenum produces "gaps" between the top acquired sheet and the second sheet. Sheets are separated either by fluffing them with air or by acquiring and corrugating them. Thus, the vacuum skirts helps lift one or more sheets from the stack so that the air knife stream and/or gravity may act on the lower sheets to separate them from the topmost sheet.

Attaching the displaceable skirts to the paper transport subsystem is relatively expensive from a manufacturing point of view. The attachment requires the use of retainers and fasteners. Burrs on the displaceable skirts may cause the skirts to bind during their vertical travel with resulting media sheet misfeeds. Additionally, air knife pressure may also cause the skirts to bind during their vertical movement. Hence, installation of the displaceable skirts is time consuming and adds expense to the manufacture of image transfer systems. Additionally, the operation of previously known displaceable skirts may not be reliable.

SUMMARY

In order to address limitations of previously known sheet feeders, an apparatus useful for feeding sheets from a stack of media sheets comprises, in certain embodiments, a plenum having an opening for coupling a vacuum source to the plenum, a slide plate having a stop member positioned proximate a drop box opening in the slide plate, and a drop box adapted to slide within the drop box opening until a portion of the drop box engages the stop member. This construction enables the drop box to be slidably installed within the opening in the slide plate without requiring fasteners for attachment. Moreover, the drop box may be formed using plastic injection molding techniques that reduce the likelihood that burrs are formed on the drop box.

A method for providing a drop box in a slide plate for a sheet feeder comprises coupling a vacuum source to an opening in a plenum, positioning a stop member on a slide plate that is proximate a drop box opening in the slide plate, and slidably installing a drop box within the drop box opening until a portion of the drop box engages the stop member. This method provides a drop box for protecting a negative pressure within the confines of the skirts of the drop box without requiring the skirts to be attached to the slide plate.

In yet another embodiment, a printing machine comprises an imaging station for obtaining an image, a transfer station for transferring the image onto a sheet, a support tray for support a stack of sheets, and a transport system for transporting a sheet from the stack to the transfer station. The transport system comprises a top vacuum corrugation feeder (TVCF) that includes a plenum having an opening for coupling a vacuum source to the plenum, a slide plate having a stop member positioned proximate a drop box opening in the slide plate, and a drop box adapted to slide within the drop box opening until a portion of the drop box engages the stop member. This construction enables the drop box to be slidably installed in the machine without require the use of metal retainers.

DESCRIPTION OF THE FIGURES

FIG. 15 is a top perspective view of one embodiment of a slide plate for a top vacuum corrugation feeder having a pair of drop box openings.

FIG. 16 is a perspective view of one embodiment of a drop box that may be slidably installed in the drop box openings of the slide plate shown in FIG. 15.

DESCRIPTION OF THE EMBODIMENTS

Figure 1:
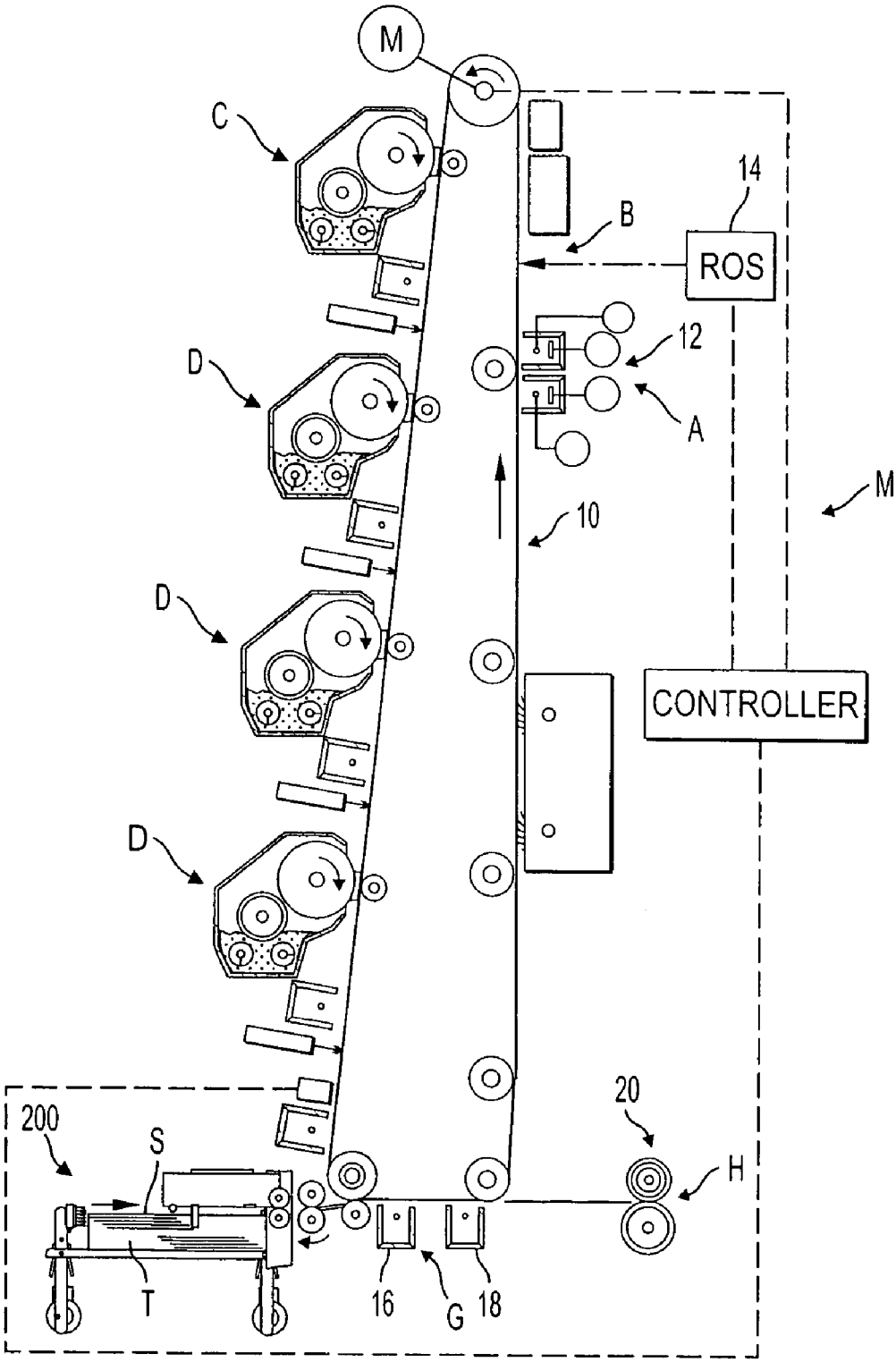
FIG. 1 PRIOR ART
FIG. 1 is a schematic elevational view of a full color image-on-image single-pass electrophotographic printing machine.
Figure 2:
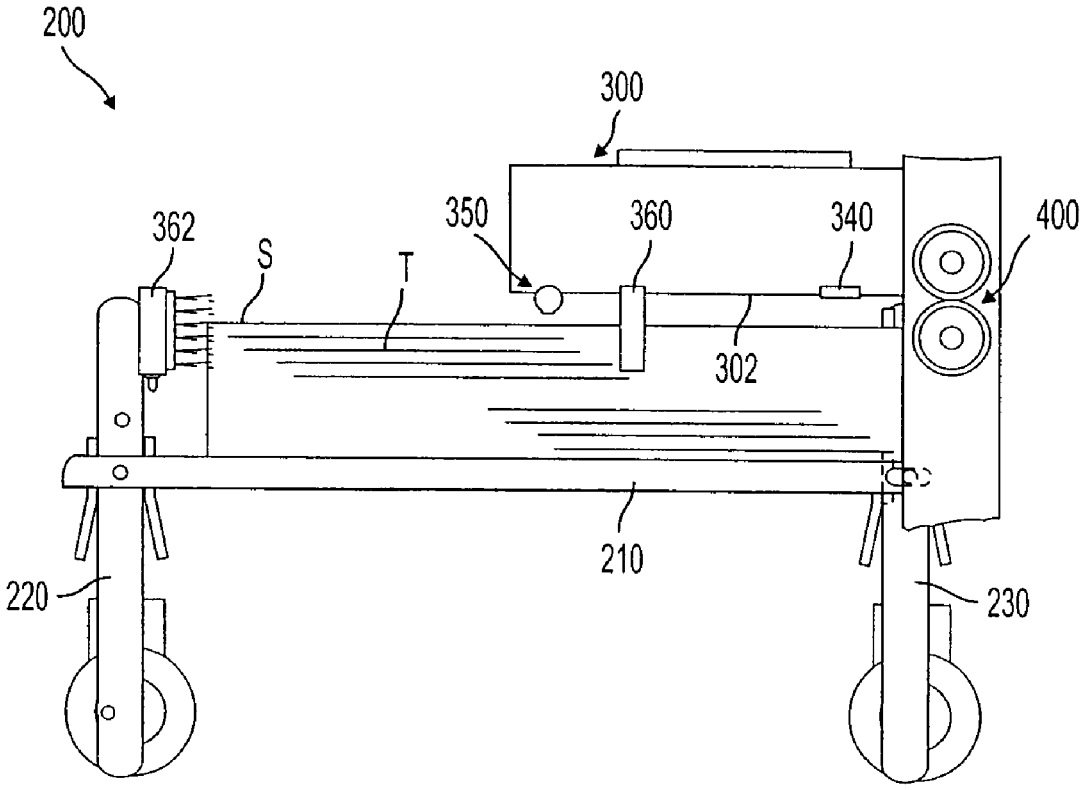
FIG. 2 PRIOR ART
FIG. 2 is a side elevational view of a known sheet feeder apparatus incorporated into the machine shown in FIG. 1.
Figure 3:
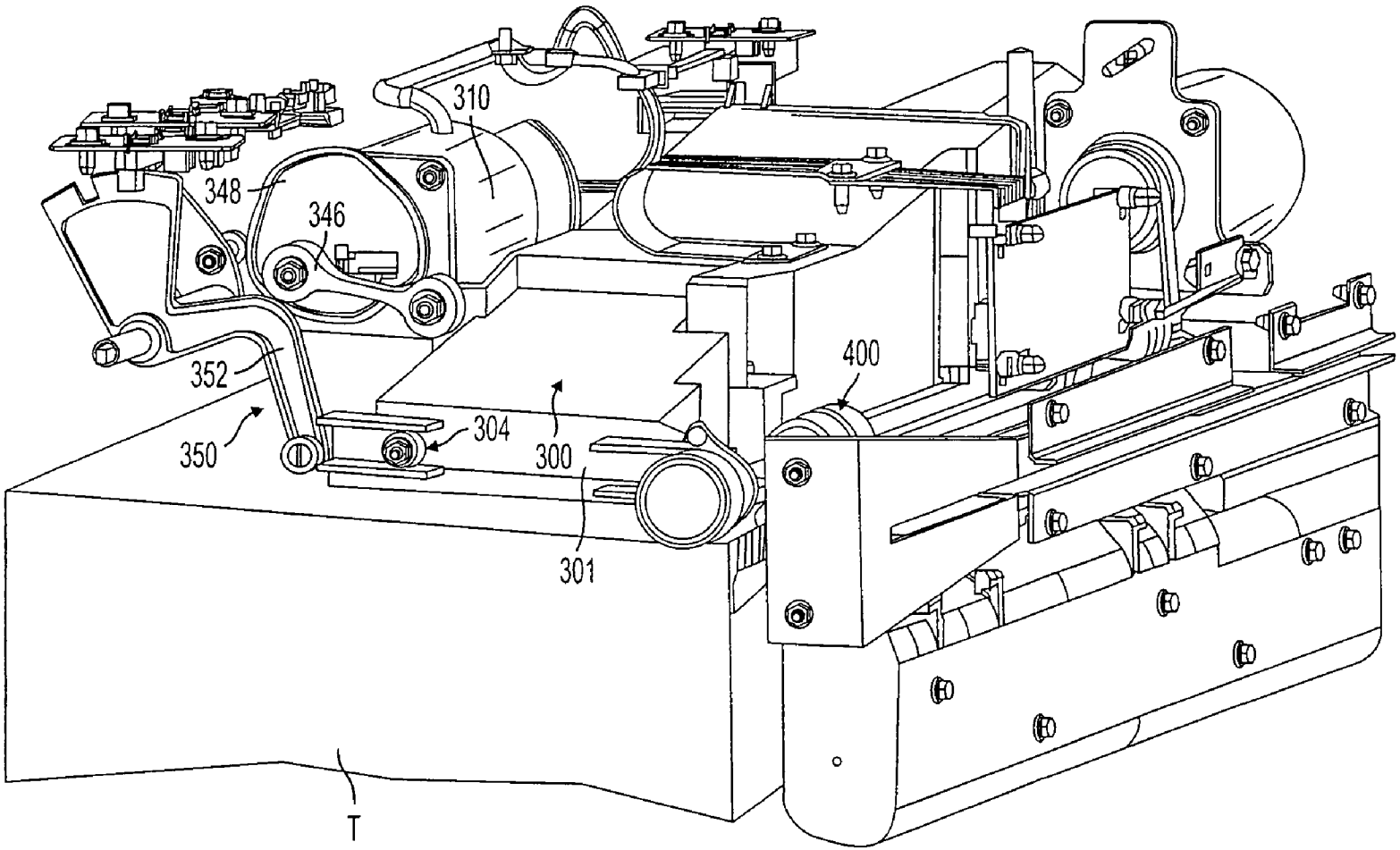
FIG. 3 PRIOR ART
FIG. 3 is a perspective view of a sheet feeder apparatus similar to that shown in FIG. 2.
Figure 4:
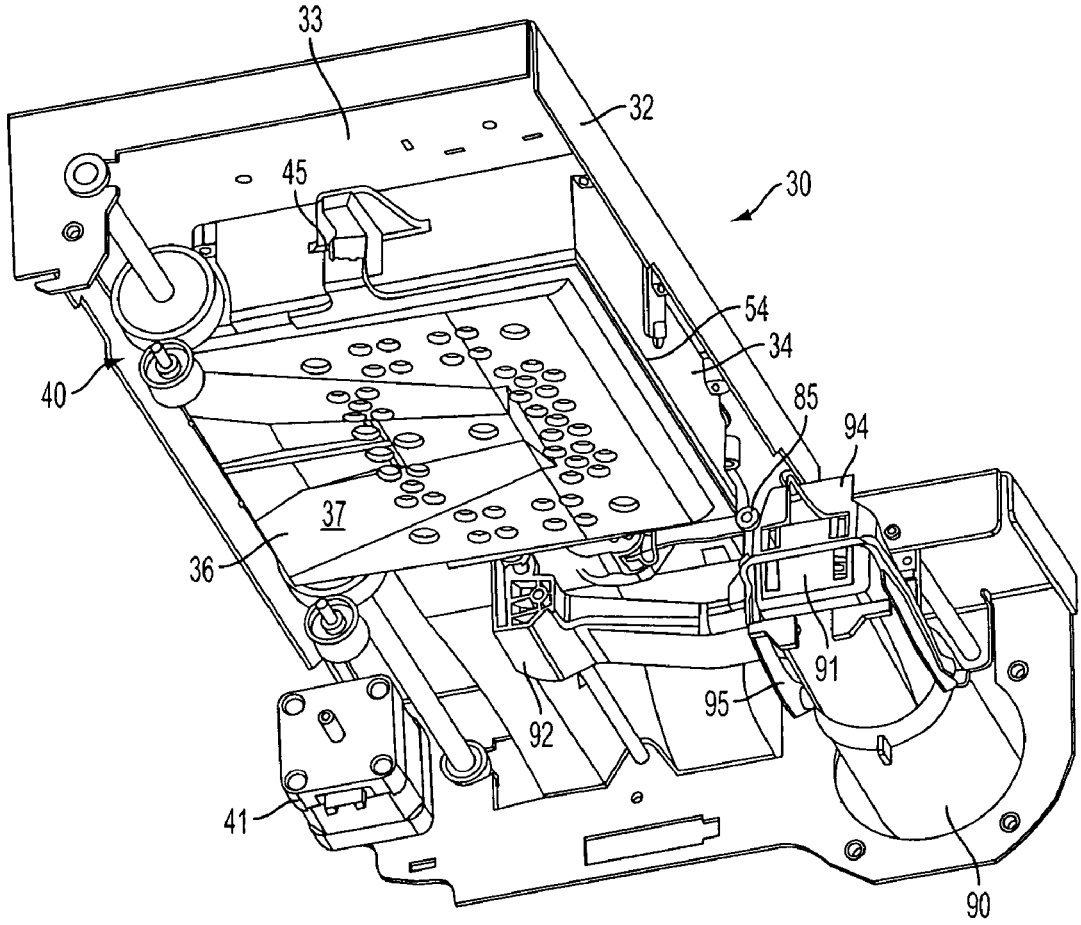
FIG. 4 is a bottom perspective view of one embodiment of a sheet feeder assembly apparatus of the present disclosure.

The present disclosure contemplates a vacuum slide sheet feeder assembly 30, as shown in FIG. 4, which replace the sheet feeder 300 and associated components described above. The assembly 30 may be used in any machine, like the electrophotographic printing or reproduction machine M shown in FIG. 1, that requires retrieval of sheet material from a stack to be conveyed along a path within the machine. In the illustrate embodiment, the sheet feeder assembly 30 is used as a top vacuum corrugated feeder (TVCF) to remove a sheet S from a stack T (see FIG. 3).

Figure 6:
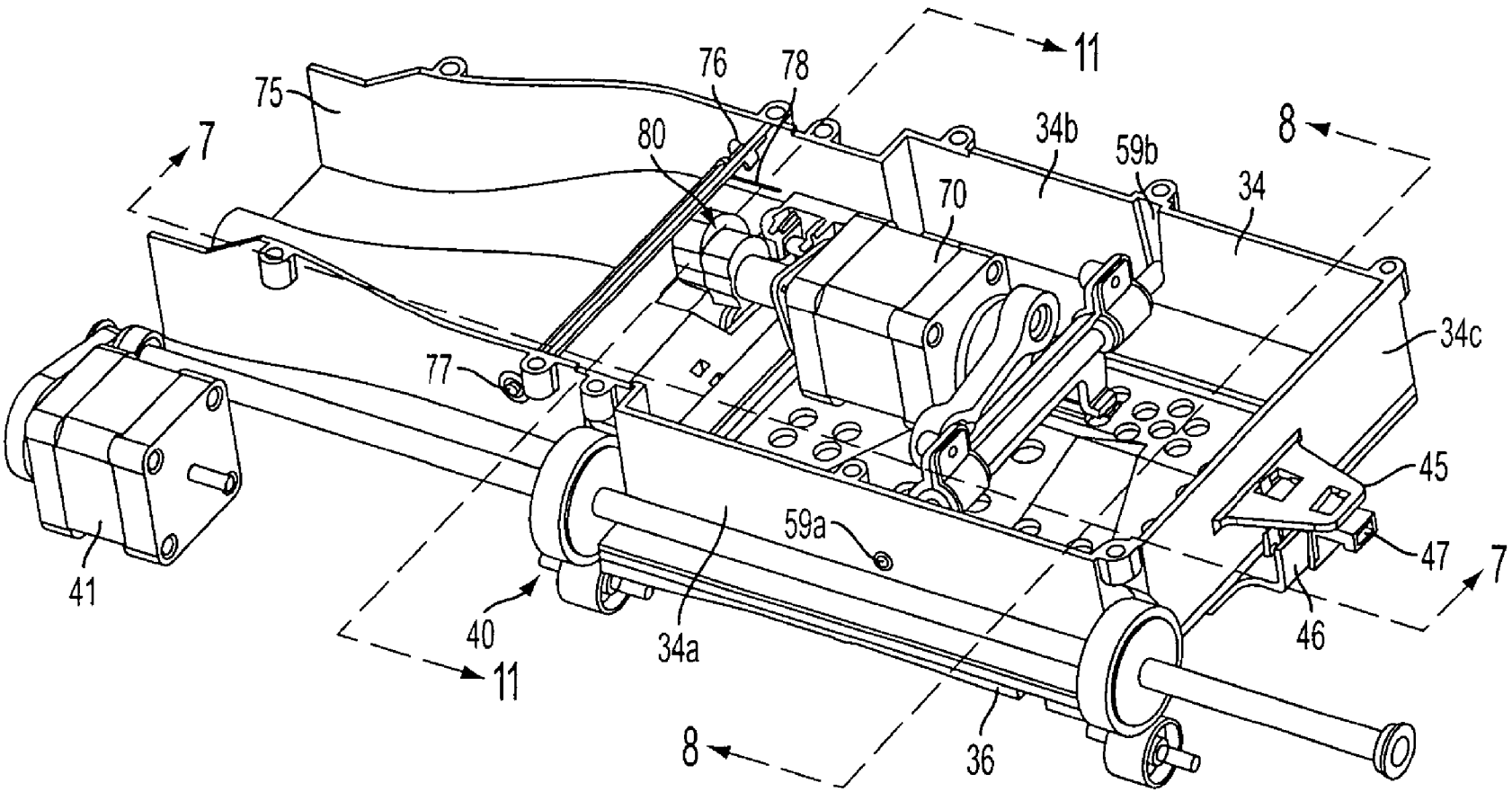
FIG. 6 is a top perspective view of the sheet feeder apparatus shown in FIG. 4, with certain components removed for clarity.

The feeder assembly 30 includes a frame 32 that supports the components of the assembly within the particular machine. Preferably, the frame is constructed so that the entire assembly 30 forms a discrete removable component for servicing or replacement. A plenum 34 is supported on the underside of a top plate 33 of the frame 32 in communication with a vacuum duct 75, as shown in FIGS. 4 and 6. The general perimeter of the plenum 34 is best seen in FIG. 6 in which the frame 32 and top plate 33 have been removed to expose the interior of the plenum. The duct 75 integrates with the vacuum source or air system of the machine that is adapted to draw a predetermined vacuum or negative pressure through the conduit. The magnitude of the negative pressure depends upon blower speed and upon the weight of the sheet S being conveyed by the sheet feeder assembly 30 in a manner that is known in the art. As will be appreciated from the following description, certain aspects of the assembly 30 allow the vacuum duct 75 to be larger in cross-sectional area than ducts connected to prior TVCF devices.

In prior TVCF devices, the entire device is transported to carry a sheet captured on the acquisition surface of the device. In accordance with one feature of the illustrated embodiment, the assembly 30 includes a slide plate 36 that closes the lower opening of the plenum 34, as shown in FIGS. 4 and 6. The slide plate 36 includes an acquisition surface 37 that is arranged to face a sheet to be acquired and conveyed. The acquisition surface 37 defines a plurality of apertures 38 through which the vacuum or suction is applied to engage the sheet S. The number, size and arrangement of the apertures 38 may be as known in the art to efficiently acquire and corrugate various types of sheet material.

In one feature of the assembly 30, the slide plate 36 is supported on the plenum 34 so that only the slide plate translates. This feature is in stark contrast to prior TVCF devices in which the entire device translates. The slide plate 36 alone translates once the sheet S has been vacuum acquired. Thus, only the drive mechanism for conveying the sheet need only be powerful enough to move the lightweight slide plate 36 and sheet S. In one specific embodiment, the slide plate 36 is formed from a thin plate of molded plastic so that the weight of the plate is minimal.

Figure 8:
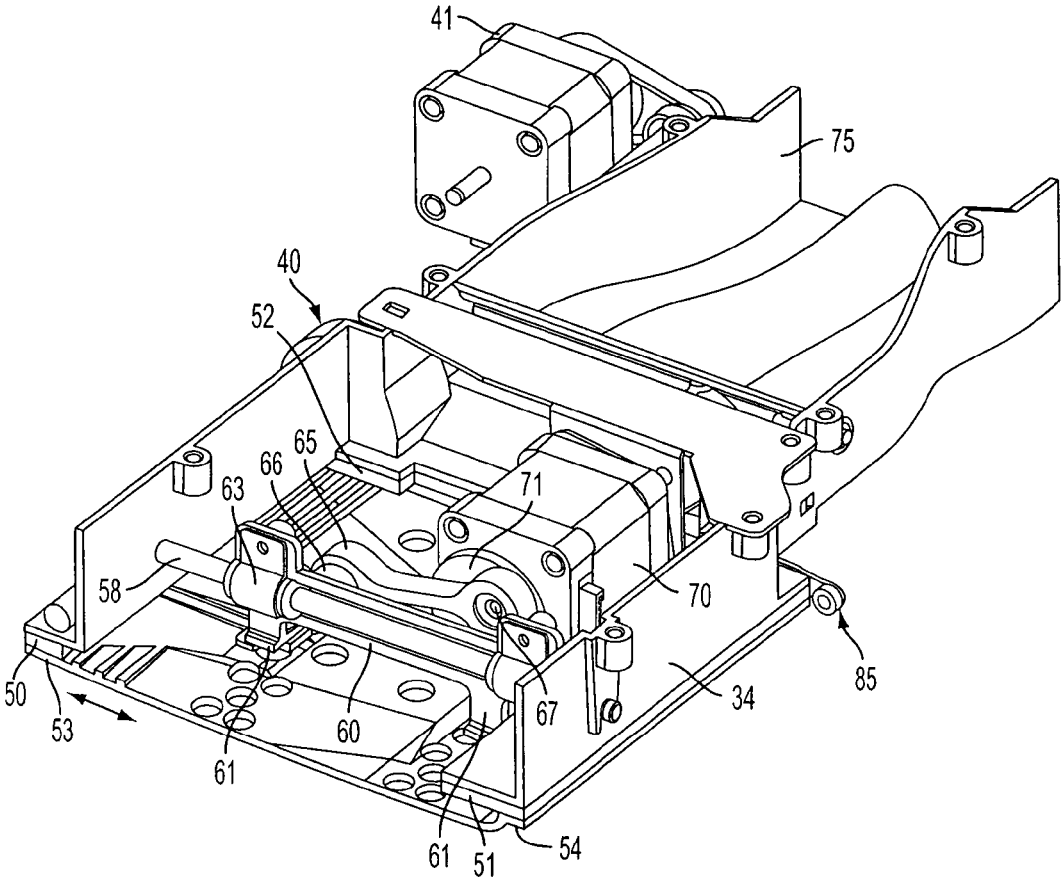
FIG. 8 is a perspective cut-away view of the assembly depicted in FIG. 6, taken along line 8-8 as viewed in the direction of the arrows.
Figure 9:
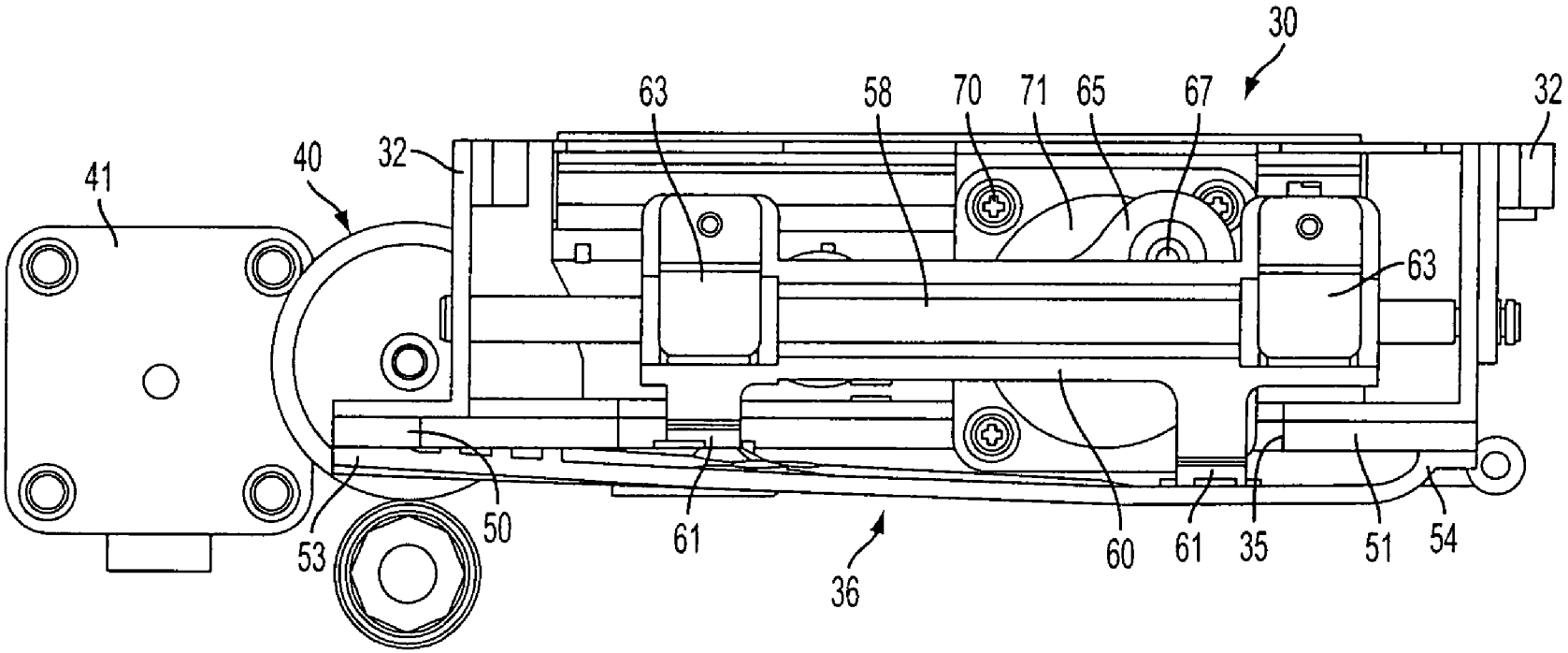
FIG. 9 is an end view of the cut-away shown in FIG. 8.

The plenum 34 includes a seal around its lower perimeter against which the slide plate 36 bears to maintain the proper vacuum within the plenum. Thus, in one embodiment, the plenum includes a front seal 50 and a rear seal 51, as shown in FIGS. 8-9, as well as side seals 52 (FIG. 8). The slide plate 36 is configured to contact each of the seals, including a front sealing flange 53 and a rear sealing flange 54 (FIGS. 8-9). The seals 50-53 may be formed together as one piece of a low sliding friction material, such as a low density closed-cell foam with an HDPE facing. In one specific embodiment, the front and rear seals 50, 51 and the front and rear sealing flanges 53, 54 are configured so that the slide plate maintains a sealing, but sliding, contact with the plenum throughout the entire length of travel of the slide plate. The travel distance of the plate 36 is determined by the location of the take-away rolls (TAR) 40, driven by motor 41, (FIGS. 4, 9) relative to the location of the stack T from which the sheet S is acquired. The motor 41 may be optional as the take away rolls may be driven by the main drives. In one embodiment, the travel distance of the plate 36 is about 20 mm.

In an alternative embodiment, the relative dimensions of the rear seal 51 and the rear sealing flange 54 may be arranged so that the vacuum pressure is vented near the end of the forward travel of the slide plate 36. This venting feature is calibrated so that when the sheet S is engaged by the TAR 40 the sheet is essentially released from the slide plate. Thus, in a specific embodiment, if the forward travel distance of the slide plate is 20 mm, the contact or overlap region of between the rear sealing flange 54 and the rear seal 51 may be about 17 mm so that the vacuum pressure is vented over the last 3 mm of travel of the slide plate. This action may reduce sheet marking that may be caused by the TAR dragging a partially held sheet across the vacuum acquisition surface.

In another feature of the disclosed embodiment, the drive mechanism for translating the slide plate 36 is situated within the vacuum plenum 34, as seen in FIGS. 6-9. In particular, a drive motor 70 is mounted to a support plate 73 (FIG. 10) that is fastened to the plenum. The motor 70 rotates a drive wheel 71 which carries an eccentric pivot mount 67. A drive link 65 is fastened at the pivot mount 67 so that rotation of the drive wheel produces reciprocation of the drive link in a known manner. The drive link 65 is connected to a slide carriage 60, which is itself fastened to the slide plate 36 by way of engagement clips 61 or other suitable fasteners. The link 65 drives the carriage 60 which ultimately translates the slide plate as the eccentrically mounted drive link reciprocates. The slide carriage 60 is supported on a support member or shaft 58 that spans between the front and rear walls 34*a*, 34*b* of the plenum 34. In the illustrated embodiment, the slide carriage 60 includes a pair of linear bearings 63 that are mounted on the shaft 58 so that the bearings slide along the shaft as the drive link 65 causes the carriage to reciprocate. The shaft may be in the form of a stainless steel rod that has one end mounted within a bore 59*a* in the front wall 34*a* and an opposite end that may be dropped into an assembly slot 59*b* in the rear wall 34*b* of the plenum.

The slide plate 36 is reciprocated between its sheet acquisition position directly above the sheet stack T to its transfer position adjacent the TAR 40 by operation of the motor 70 and reciprocation of the drive link 65. The slide plate 36 is supported relative to the plenum 34 by the slide carriage 60. Contact between the slide plate 36 and the seals 50-52 help prevent leakage of the vacuum pressure as it translates. In order to locate a "home" or start position for the slide plate 36, the slide plate may include a home flag 46 to actuate a home sensor 47 mounted in a molded tab 45 at one side of the plenum as shown in FIG. 6. Straight tracking of the slide plate 36 is ensured by the shaft 58 and bearings 63.

Mounting the slide plate drive mechanism within the plenum 34 reduces the overall envelope occupied by the sheet feeder assembly 30 within the machine M. In prior TVCF devices, the motor used to drive the device is positioned adjacent the vacuum duct, and in fact infringes on the duct area. With the present embodiment, placing the motor 70 within the plenum 70 means that the vacuum duct 75 is not compromised so that full vacuum flow may be drawn through the duct.

Figure 7:
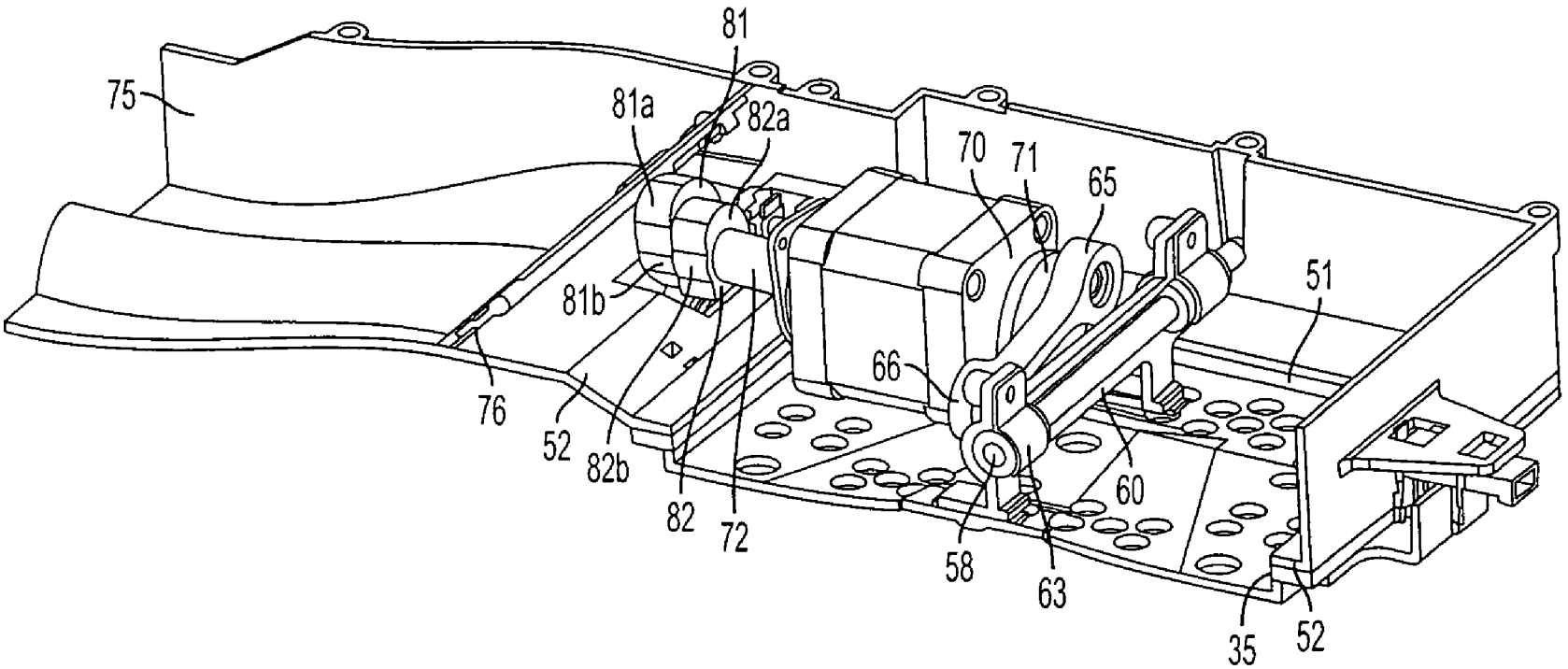
FIG. 7 is a perspective cut-away view of the assembly depicted in FIG. 6, taken along line 7-7 as viewed in the direction of the arrows.
Figure 10:
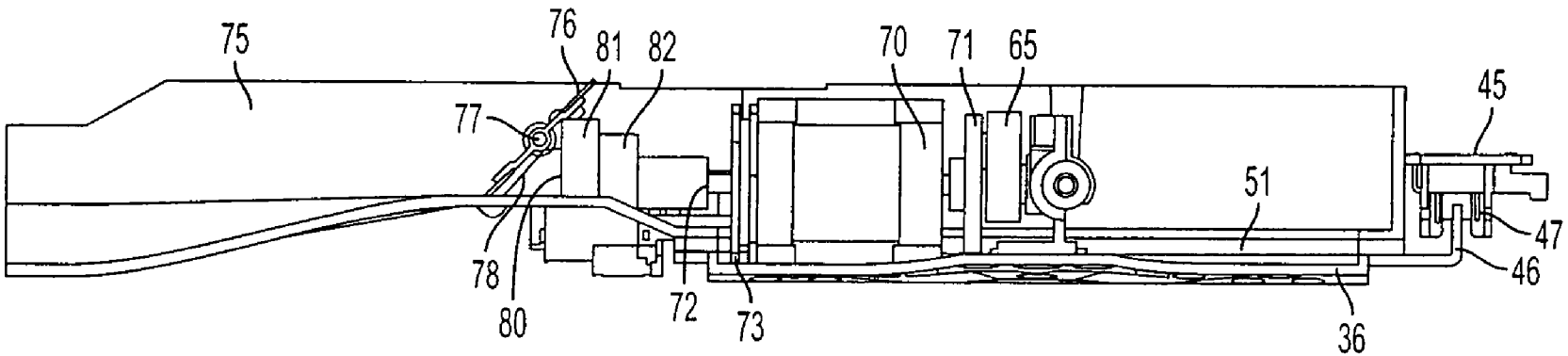
FIG. 10 is a side view of the cut-away shown in FIG. 7.

As is known in the art, the vacuum applied to the feeder assembly is controllable, at a minimum with respect to the amount of time that vacuum is drawn through the acquisition surface. Thus, the feeder assembly 30 provides means for controlling the vacuum drawn through the plenum 34 and slide plate 36. In particular, the assembly is provided with a flapper valve 76 that is disposed between the duct 75 and the plenum 34, as shown in FIGS. 6, 7 and 10. The valve 76 is pivotably mounted about an axle 77 that spans the side walls of the duct. A torsion spring 78 is preferably arranged to bias the flapper valve 76 against value cam 81 so the plenum 34 is open to the duct. The walls of the duct 75 may include features against which the flapper valve seats to ensure an acceptably tight seal between the duct and the plenum when the flapper valve is in its closed position, as depicted in FIG. 10.

As is also known in the art, a motor driven cam may be used to move the flapper valve from its biased open position to a closed position. Thus, the feeder assembly 30 of the present disclosure also includes a cam element 80 that is mounted to a drive axle 72 of the motor 70. The cam element 80 includes a flapper cam portion 81 that is arranged to contact the flapper valve 76. In particular, the flapper cam portion 81 includes a lobe 81*a* (see FIG. 7) that bears against the valve 76 to push against the torsion spring 77 and dislodge the valve from the sealing features within the duct 75. The cam portion also includes a flat 81*b* that is sized to avoid contact with the flapper valve. Thus, it can be appreciated that the arrangement of lobe and flat determines the open-close cycle for the flapper valve, and ultimately the timing of the vacuum at the acquisition surface 37 to acquire a sheet S from the stack T. Moreover, it is understood that the configuration of the lobe 81*a* determines the dwell period for the flapper valve so that the valve remains open as the sheet S is being conveyed by translation of the slide plate 36. The lobe is configured so that the flapper valve is closed once the sheet has reached the TAR 40.

In one feature of this embodiment, the cam 80 and flapper cam portion 81 are driven by the same motor 70 that drives the slide plate 36. As explained above, since the motor is not required to drive the entire feeder assembly 30 (as in prior devices), the entire power output from the motor need not be dedicated solely to moving the acquisition surface. In other words, the same motor used to drive the prior art feeder assembly 300 (FIG. 3) may drive not only the slide plate 36 but also the cam element 80. The timing of the slide plate movement is automatically and mechanically linked to the timing of the rotation of the flapper cam portion 81 since they are both driven off the drive axle 72 of the motor 70. Another benefit of the presently disclosed flapper valve is that the motor and cam are contained within the plenum 34, rather than outside the duct or plenum, thereby simplifying the overall structure and envelope of the feeder assembly 30.

Figure 5:
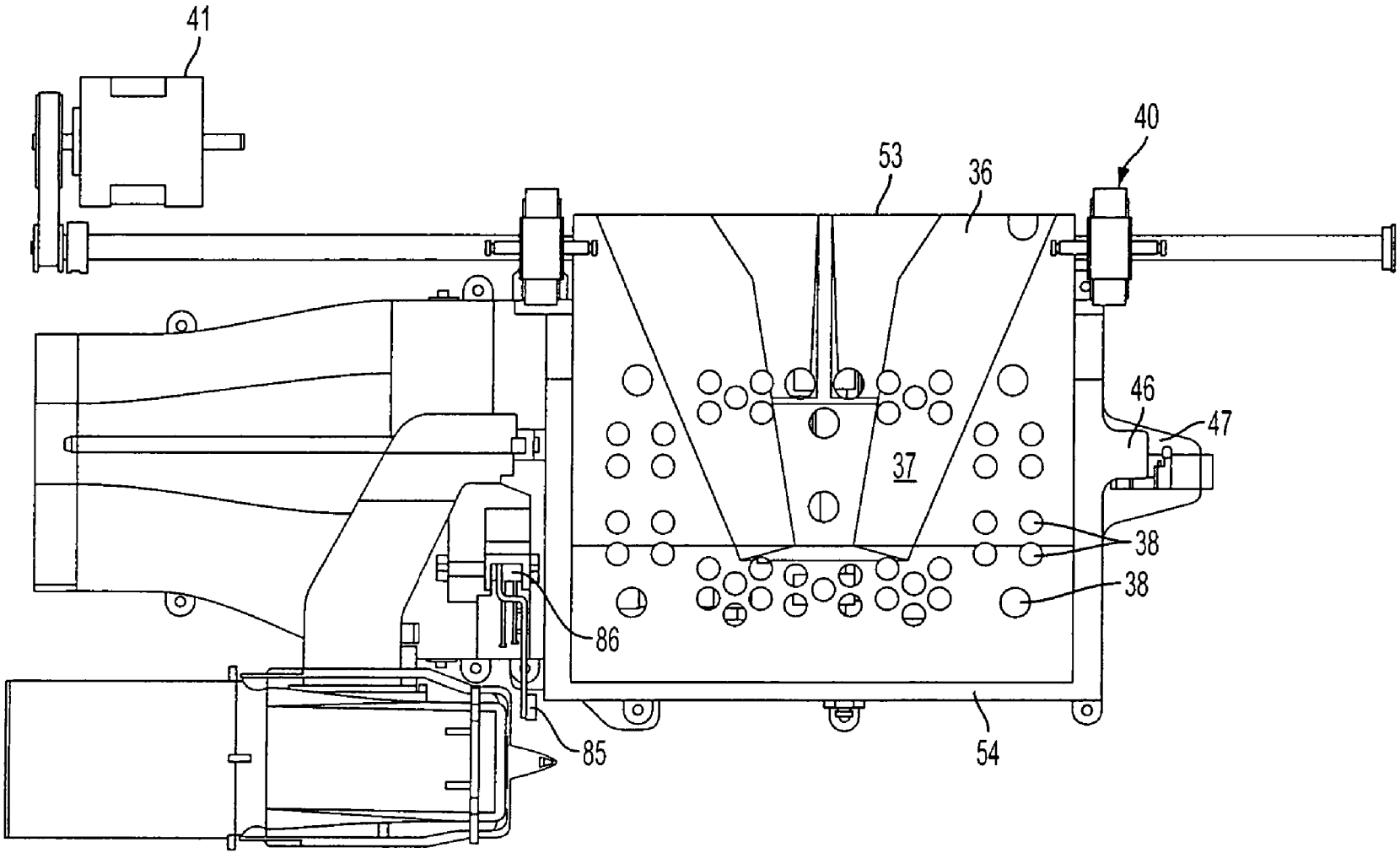
FIG. 5 is a bottom view of the sheet feeder apparatus shown in FIG. 4, with the assembly frame removed for clarity.
Figure 11:
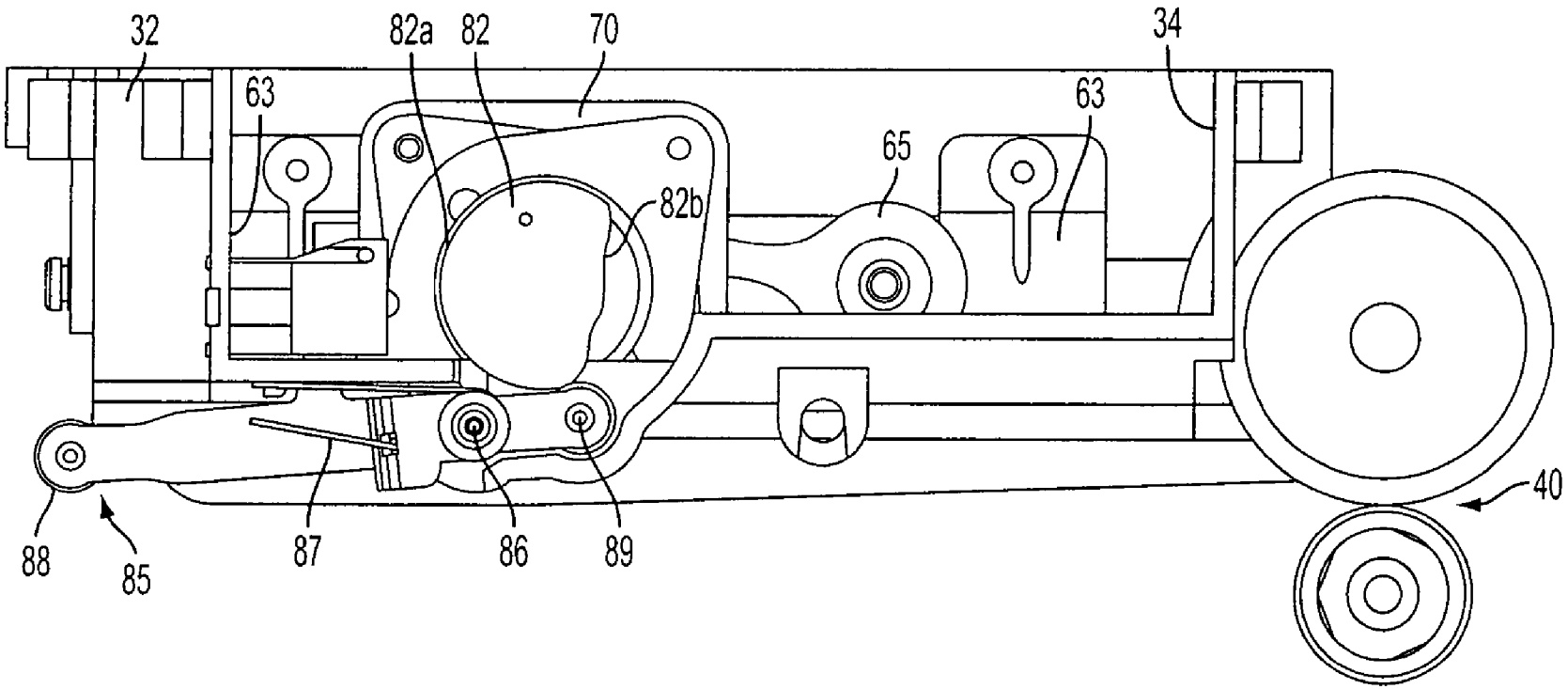
FIG. 11 is an end cut-away view of the assembly depicted in FIG. 6, taken along line 11-11 as viewed in the direction of the arrows.
Figure 12:
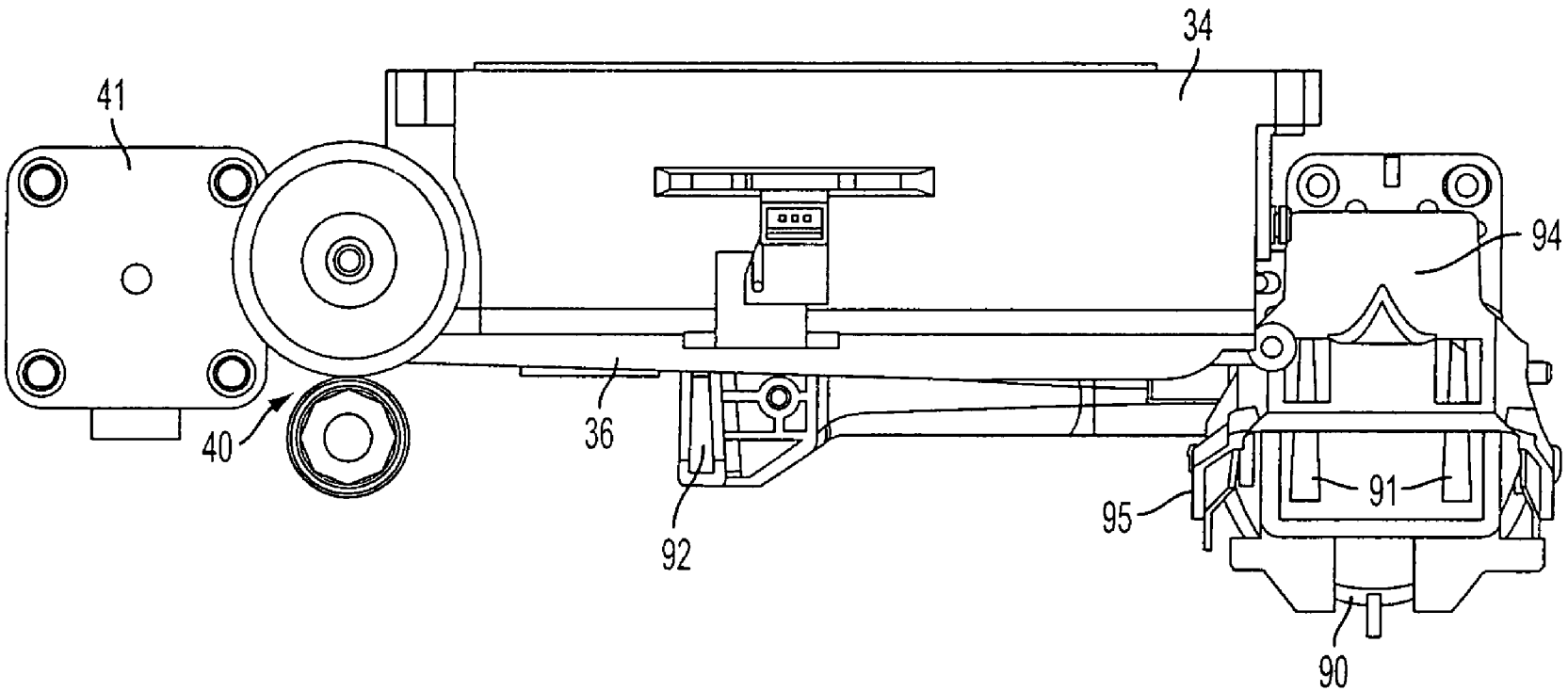
FIG. 12 is an end elevational view of the assembly illustrated in FIG. 4 with certain components removed for clarity.
Figure 13:
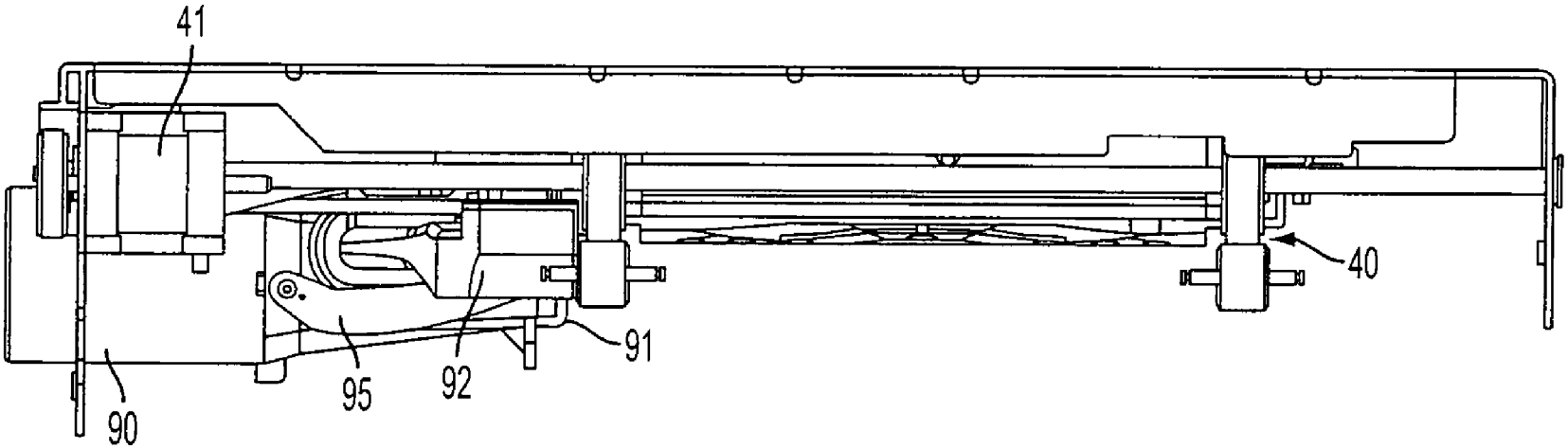
FIG. 13 is a front elevational view of the assembly depicted in FIG. 4 with certain components removed for clarity.

In addition to controlling the flapper valve 76, the same motor 70 that drives the acquisition surface may also be used to control the operation of a height sensing arm 85. It is known in prior machines to provide a mechanical height sensing arm that is retracted when a sheet is being acquired and conveyed to the take-away rolls and that is dropped into contact with the stack T to determine the height of the stack. The present assembly 30 includes a height sensing arm 85 that extends below the plenum 34 and slide plate 36, as shown in FIGS. 5, 8 and 11. The arm 85 includes a pivot mount 86 that may be situated between the duct 75 and the plenum 34 (FIG. 5). A biasing spring 87, such as a torsion or leaf spring, engages the height sensing arm 85 to bias the contact end 88 toward the stack (i.e., downward in FIG. 11).

As with the flapper valve, the operation of the height sensing arm 85 is controlled by a cam. In particular, the cam element 80 includes a sensing cam portion 82 that is arranged to contact a cam follower 89 forming part of the height sensing arm 85. The sensing cam portion 82 includes a lobe 82*a* and a flat 82*b* that control the movement of the follower 89, and ultimately the contact end 88 of the sensing arm 85. In particular, when the lobe 82*a* is in contact with the follower 89, the contact end 88 is elevated from the stack T. When the cam portion 82 is rotated further, the bias spring 87 biases the follower 89 into contact with the flat 82*b*, which allows the contact end 88 to contact the stack T.

Again, like the flapper valve control, control of the height sensing arm 85 is based on the operation of a common motor. The motor 70 thus controls three functions of the feeder assembly 30—movement of the acquisition surface 37 and the sheet S, movement of the flapper valve 76 and movement of the height sensing arm 85. Also, as with the flapper valve control, the movement of the height sensing arm is automatically and mechanically linked to the movement of the acquisition surface and slide plate because the same motor 70 is used. The configuration of the cam portion 82 fixes the timing of the lifting of the sensing arm 85 as the slide plate 36 acquires the sheet S and propels it toward the TAR 40, as well as the timing of the release of the sensing arm 85 to compress the stack and measure the stack height after the sheet has been released and the slide plate 36 is being withdrawn to its neutral position.

The feeder assembly 30 may include an arrangement of fluffer jets that are arranged to fluff the top sheet of a stack to facilitate acquisition by the slide plate. Thus, the frame 32 may support a fluffer plenum 90, as shown in FIGS. 4, 5, 12 and 13, that is connectable to an air supply. The plenum 90 terminates in a main fluffer jet(s) 91 and may feed a leading edge fluffer 92 that is disposed closer to the leading edge of the sheet. A fluffer gate 94 is pivotably supported on the frame by a gate arm and is movable to open and close the main fluffer jet 91 in a known manner.

The feeder assembly 30 disclosed herein provides significant advantages over prior sheet feeder systems. As explained above, rather than translating the entire feeder assembly as in prior systems, the assembly 30 provides for translation of only the acquisition surface and the sheet carried by the surface. Thus, only the slide plate 36 and the carried sheet S is driven by the motor 70. In a specific embodiment, the slide plate has a transported mass of only about 100 gm, or about $1/5^{th}$ the transported mass of some prior feeder systems. This lower transport mass not only reduces the power requirements for the drive motor 70, it also translates into lower inertia and ultimately to quicker/faster transport of the acquisition surface and sheet S carried thereby. In the specific embodiment, the assembly 30 may be capable of sheet feed rates of up to 200 pages per minute, or even greater.

The reduced power requirements for transporting the acquisition surface and sheet may be manifested in a smaller motor, or more preferably in the integration of multiple functions from a common motor. Thus, as disclosed above, the motor 70 drives the slide plate 70 and rotates the cam element 80 that controls the movement of the flapper valve 76 and the height sensing arm 85. The motor power must be sufficient to overcome the biasing force generated by the torsion spring 78 restraining the flapper valve and the spring 87 biasing the height sensing arm. Combining several functions into the common package of the feeder assembly 30 can allow usage of the motor that had been used to drive prior vacuum valves to instead drive the take-away roll (if needed), especially in high speed applications.

The feeder assembly 30 provides a very compact and modular package for placement within the printing machine M. Since multiple functions are combined into a single package, the individual motors and driver PWBAs associated with prior feeder systems are eliminated. Moreover, the common drive motor allows repositioning of certain functional components within the plenum region that could not be achieved with prior systems. For instance, the height sensing arm 85 may be located closer to the feed head or acquisition surface, rather than near the trailing edge as in prior systems. This location for the height sensing arm improves the accuracy of location of the top of the fluffed stack relative to the acquisition surface, especially for long sheet length or for curled sheets.

Another benefit is that the working parts are wholly contained within the envelope of the vacuum plenum 34. Mounting the motor 70 within the plenum reduces the overall outer dimension of the entire assembly 30 and, as indicated above, frees up space of the vacuum duct 75. The larger available vacuum duct eliminates the feed head skirts in prior sheet acquisition systems that were necessary to overcome high vacuum system impedance. Since the slide plate 36 and cam element 80 are driven from a common motor, additional drive components are eliminated, such as cable drives and pulleys associated with prior feeder systems. The substantially direct drive between the motor 70 and the carriage 60 supporting the slide plate also eliminates the additional drive components of prior systems and reduces the mechanical losses associated therewith.

The motor 70 is preferably an electric motor, and may be a stepper motor capable of stepwise movement or rotation. Thus, the motor is capable of controlled rotation to coordinate the several functions of the feeder assembly 30. It is contemplated that the motor may be operated for continuous high-speed rotation without compromising the function of the drive link 65 and cam element 80.

Figure 14:
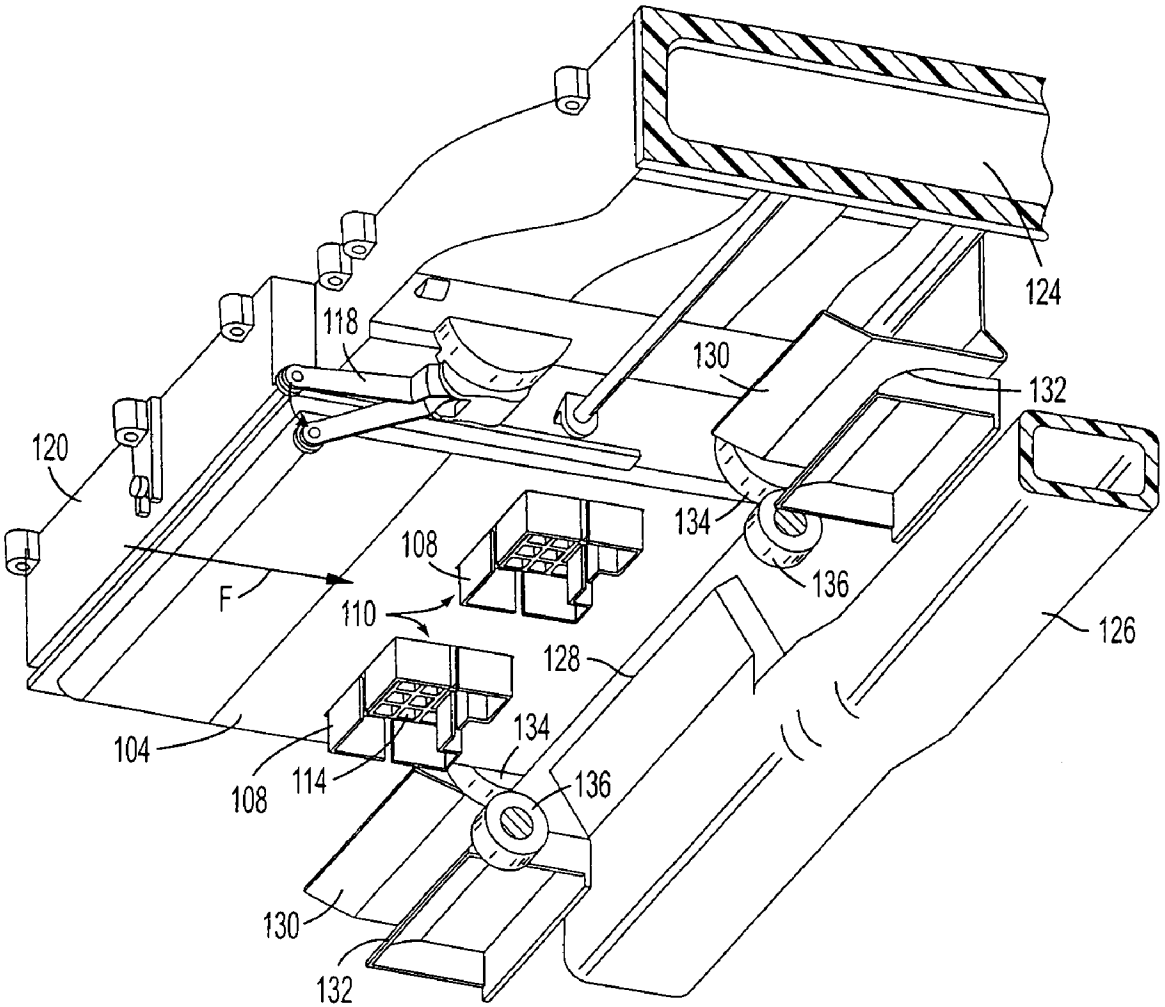
FIG. 14 is a bottom perspective view of one embodiment of a sheet feeder apparatus with a pair of drop boxes slidably installed therein in accordance with the present disclosure.

As shown in FIG. 14, a slide plate for a top sheet feeder may be modified to incorporate drop boxes that do not require retainers for assembly with the slide plate. The feeder 120 includes a vacuum duct to which a vacuum source may be coupled so a negative pressure may be presented at the opening in the plenum described above. The stack height sensing arm 118 may be controlled to move the slide plate 104 in a manner similar to that described above. The slide plate 104 includes two drop box openings 110 through which drop boxes 108 may be slidably installed. A grid 114 may be formed across each of the openings 110 in a manner described more fully below. The drop boxes 108 enable the negative pressure present at the opening in the plenum to also exist within the volume of the drop boxes because the opening in the plenum is in fluid communication with the openings 110 in the slide plate 104. As the stack height sensing arm 118 drops the slide plate 104, the drop boxes also approach the top sheet on a stack of sheet media and the negative pressure urges the upper surface of the top sheet towards the lower surface of the drop boxes 108.

Because the drop boxes are slidably installed in the openings 110, the stiffness and momentum of the sheet pushes the drop boxes 108 upwardly within the openings 110. After the boxes 108 slide upwardly and the sheet has acquired and corrugated during a delay time, the slide plate moves in the feed direction, the leading edge of the sheet or sheets travels towards the discharge 128 of the air knife duct 126. The openings 110 in the slide plate 104 and the drop boxes 108 placed within them are laterally offset from the center of the air knife stream flow to reduce the drag induced by the air knife stream impinging on the boxes 108. The gap between the boxes 108 facilitates the flow of the air knife stream between the boxes 108. In one embodiment, this gap is approximately 45 mm. Additionally, the boxes 108 have slots formed in the skirts of the boxes, as described more fully below, to enable the vertical movement of the boxes and to reduce further any drag that may arise from the air knife stream impinging on the boxes 108. The air knife stream helps separate the top sheet from any sheets that may have followed the top sheet as it was urged against the drop boxes 108. As the slide plate moves in the feed direction and the sheets beneath the top sheet fall away under the effects of gravity or the air knife stream, the lead edge of the top sheet is fed between the upper paper baffles 130 and the lower paper baffles 132. The take away rollers 134 and 136 may then transport the sheet into the imaging section of the machine.

FIG. 15 depicts one embodiment of a slide plate that incorporates a pair of drop box openings 110. The slide plate 104 is provided with additional apertures 140 to help present a negative pressure in the vicinity of the stack of media sheets. Within the drop box openings 110, a grid 114 is disposed across the openings. The grids are connected to the slide plate 104 by stop members 142. When a drop box is placed within an opening 110, the stop members 142 engage the drop box to stop the vertical descent of the drop boxes. One or more stop members may be provided in an opening 110 without connecting a grid within the opening 110. As shown in FIG. 15, standoffs 144, may be provided at locations proximate the opening 110. After a drop box has been installed in an opening 110, a stop member (not shown) may be installed on the standoffs to engage the drop box as it moves upwardly within the opening 110. These stop members may be used to entrap a drop box installed within an opening 110 yet preserve the ability of the drop box to vertically slide within the openings 110. The slide plate 104 shown in FIG. 15 is a slide sheet for a top vacuum corrugated feeder, while the slide plate 104 shown in FIG. 14 is a smooth slide plate. The drop box openings and drop boxes described herein may be used with slide plates to enhance the presentation of a negative pressure at a top sheet of a media sheet stack to facilitate the removal of a top sheet from the stack. The size of the drop box may be varied to increase the enclosed volume for the vacuum as required.

A drop box 108 that may be used within the openings 110, for example, is shown in FIG. 16. The drop box 108 includes a plurality of skirts 150 that may be formed so a portion of the skirts join the skirts together in a manner that leaves slots 154. Additionally, a cutout 158 may be provided to provide clearance for stack "fang" at the lead edge. To install a drop box, the slots 154 are aligned with the stop members in the openings 110 of the slide plate 104. A box 108 may then be released so the box falls within the opening 110 until the connecting portions 152 of the skirts 150 rest on the stop members 142. This method of installation does not require retainers and the like for assembly of the sheet feeder. If stop members are installed on the standoffs 144, the drop box cannot ascend within the opening 110 beyond the height of the skirts 150 that comprise the drop boxes 108. Thus, the drop boxes 108 are retained within the openings 110 without requiring the use of relatively expensive metal retainers or the like.

The drop box shown in FIG. 16 may be formed from lightweight plastic using a plastic injection molding method. The light weight of the drop box enables the box to move as the paper is urged upwardly by the negative pressure within the volume defined by the skirts of a drop box 108. The tolerances of the slots 154 need not be as exact as channels for previously known skirts that require metal retainers and the like for their installation. Consequently, the drop boxes 108 are not likely to bind during the operation of a sheet feeder in which the drop boxes are installed.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus useful for acquiring and conveying a sheet comprising:

a plenum having an opening for coupling a vacuum source to the plenum;

a slide plate having a pair of drop box openings in the slide plate, each drop box opening having at least one stop member; and a pair of drop boxes, each of which is adapted to slide within one of the drop box openings until a portion of the drop box engages the stop member in one of the drop box openings to enable each drop box to be slidably installed in the slide plate.

2. The apparatus of claim 1, each of the drop boxes further comprising:

a plastic frame having a plurality of skirts that extend from the plastic frame with at least two of the skirts having a slot formed therein to receive the stop member.

3. The apparatus of claim 1 wherein each drop box is laterally offset from an air knife stream.

4. The apparatus of claim 3 wherein the drop boxes are separated from one another by a gap of approximately 45 mm to enable the air knife stream to flow between them.

5. The apparatus of claim 1, the slide plate further comprising:

at least one standoff proximate one of the drop box openings, the standoff extending upwardly from the slide plate; and a stop member extending from the standoff to engage the drop box as the drop box slides upwardly within the drop box opening.

6. The apparatus of claim 5, the slide plate further comprising:

a plurality of standoffs proximate each drop box opening, each of which has a stop member extending from the standoff to engage the drop box as the drop box slides upwardly within the drop box opening proximate the standoffs from which the stop member extends.

7. The apparatus of claim 1, each drop box opening further comprising:

a grid across each drop box opening, each grid being connected to the slide plate by the stop member within the drop box opening in which the grid is located.

8. A method for acquiring and conveying a sheet comprising:

coupling a vacuum source to an opening in a plenum;

positioning a plurality of stop members on a slide plate, each stop member being proximate a drop box opening in the slide plate, the slide plate having at least a pair of drop box openings; and slidably installing a drop box within each drop box opening until a portion of the drop box engages the stop member within the drop box opening in which the drop box is installed.

9. The method of claim 8 further comprising:

receiving the stop member proximate a drop box opening within a slot in a skirt of the drop box installed in a drop box opening to enable the drop box to extend from the slide plate.

10. The method of claim 8 further comprising:

laterally offsetting each of the drop boxes from an air knife stream path over the slide plate.

11. The method of claim 10 further comprising:

separating the drop boxes from one another by a gap of approximately 45 mm to provide the air knife stream path between them.

12. The method of claim 8 further comprising:

extending a stop member from a standoff located proximate one of the drop box openings to enable the stop member to engage the drop box installed within the drop box opening proximate the standoff as the drop box slides upwardly within the drop box opening.

13. The method of claim 12 further comprising:

extending a stop member from each standoff in a plurality of standoffs, each drop box opening in the slide plate having at least one standoff proximate the drop box opening to enable each stop member to engage the drop box as the drop box slides upwardly within the drop box opening, proximate the standoff from which the stop member extends.

14. The method of claim 8 further comprising:

connecting a grid to the slide plate for each drop box opening in the slide plate, one grid being located across each drop box opening.

15. A printing machine comprising:

an imaging station for obtaining an image;

a transfer station for transferring the image onto a sheet;

a support tray for supporting a stack of sheets;

a transport system for transporting a sheet from said stack to said transfer station, said transport system including a top vacuum corrugation feeder (TVCF) that includes:

a plenum having an opening for coupling a vacuum source to the plenum;

a slide plate having a pair of drop box openings with at least one stop member positioned proximate each drop box opening in the slide plate; and a drop box within each drop box opening in the slide plate, each drop box being adapted to slide within the drop box opening until a portion of the drop box engages one of the stop members positioned proximate the drop box opening in which the drop box is located.

16. The printing machine of claim 15, wherein the drop boxes in the pair of drop box openings are laterally offset from an air knife stream path over the slide plate.

17. The printing machine of claim 16, wherein the drop boxes in the pair of drop box openings are separated by a gap through which the air knife stream flows.

* * * * *